United States Patent [19]

Liebig

[11] 4,453,056

[45] Jun. 5, 1984

[54] DRIVING ARRANGEMENT FOR ELECTRICAL SWITCHES WITH AN INDEPENDENT TRIP RELEASE MECHANISM

[75] Inventor: Reinhard Liebig, Berlin, Fed. Rep. of Germany

[73] Assignee: Siemens AG, Berlin and Munich, Fed. Rep. of Germany

[21] Appl. No.: 484,098

[22] Filed: Apr. 11, 1983

[30] Foreign Application Priority Data

Apr. 19, 1982 [DE] Fed. Rep. of Germany ..... 3214935

[51] Int. Cl.[3] ..... H01H 3/30

[52] U.S. Cl. ..... 200/153 SC; 200/322

[58] Field of Search ..... 200/153 SC, 318, 322

[56] References Cited

FOREIGN PATENT DOCUMENTS 2841821 5/1979 Fed. Rep. of Germany ..... 200/318

WO82/04496 12/1982 PCT Int'l Appl. ..... 200/153 SC

*Primary Examiner*—John W. Shepperd

*Assistant Examiner*—Renee S. Kidorf

*Attorney, Agent, or Firm*—Karl F. Milde, Jr.; Andrew G. Rodau

[57] ABSTRACT

A driving arrangement for electrical switches is described, which has a mechanical independent trip release mechanism. Toward this end, a coupling lever 46 is situated between a driving lever 26 and a coupling bar 27, whereby said coupling lever 46 is arranged on the coupling bar 27 and operated by a stationary configuration. For that purpose, an independent trip release lever 56 has been provided which is pivoted together with an activating element 55 for the coupling 46 by an off-switch jack 40 during the switch-off mode. The described independent trip release mechanism has been designed for manual or self-activating release as well as activation upon removal of a movable switch from a regulating cell. The new driving arrangement is especially suitable for applications with medium voltage type output switches, such as switches equipped with vacuum switching tubes.

2 Claims, 3 Drawing Figures

DRIVING ARRANGEMENT FOR ELECTRICAL SWITCHES WITH AN INDEPENDENT TRIP RELEASE MECHANISM

BACKGROUND OF THE INVENTION

This invention relates to a driving arrangement for electrical switches equipped with apparatus to store power to switch-on or close electrical switch positions and to simultaneously activate apparatus to store power to switch-off the switch, as well as interlocking elements to maintain the stored switch-off power and a trip mechanism to release the switch-off power, whereby a horizontally movable coupling bar has been provided to transfer the switch-on power from one driving lever to a subsequent gear shift lever, and whereby, in addition an independent trip release configuration has been included enabling a switch-off mode independent of a switch-on command.

A driving arrangement of this type is disclosed in U.S. Pat. No. 3,778,568. In this case the independent trip release configuration is part of the interlocking arrangement which maintains the switch in its ON position. Toward this end, the interlocking arrangement has been designed as an elbow type lever system with three separate levers. If these elbow type levers are moved, the off-switch power store is activated, while the simultaneously discharging on-switch power store remains inactive. Interlocking modes with the above described dual functions require relatively expensive installations. Therefore, efforts have been made to reduce these costs by, for example, carrying out the trip release function electrically by electrically interlocking the activation magnets for the switch-on and switch-off mode in a suitable manner. However, if the required support power is not available for the interlocking process, interruptions may occur.

SUMMARY OF THE INVENTION

It is an object of this invention to provide a self-activating mechanical trip release configuration for the driving arrangement of electrical switches, which are only provided with a simple interlocking configuration and with which the function of the independent trip release can be performed electrically, if such should be required.

According to the invention, this task has been solved with respect to the previously mentioned driving arrangement in that a removable coupling separated from the switch-on interlock is arranged between a driving level and the coupling bar. This removable coupling includes an oblong hole arranged in longitudinal direction on the coupling bar and a coupling bolt situated at the driving lever and interacting with the oblong hole, as well as a two armed coupling lever which has been arranged in a pivotable mode at the coupling bar. The two armed coupling lever is provided with a working surface to interact with the coupling pin. This two armed coupling lever can be swivelled by an activating link vertically rotatable in relation to the coupling bar. It has been proven, that this removable coupling can be included without requiring basic transformations of entire systems in previously utilized driving arrangements possessing the previously mentioned relatively simple construction. In particular, the current spatial arrangement of the various waves, levers and interlocking parts does not require any changes. To meet the required function of the independent trip release configuration merely a number of previously used parts have to be substituted by others or a few other necessary parts have to be added.

Upon further development of the invention, it is possible to connect the activating element provided for the coupling lever with a swivel type independent release lever located at its end, which can be sidetracked from a rest position which corresponds to one of the coupled positions of the coupling lever against the direction of a resetting spring, by a pin which is activated by an off-switch jack of the release mechanism.

The independent release lever offers the advantage of operating the coupling between the driving lever and the coupling bar by a release mechanism located at the switch position. It also enables operation with, for example, parts normally included in the transport of a switch assembly. In this manner, it is possible to insure that the switch cannot be activated when it is placed in an inoperative position.

In general, the invention features, in one aspect, the combination of the driving arrangement for an electrical switch having first means for storing power to switch-on the switch, second means for storing power to switch-off the switch, the first and second means being activated at substantially the same time, interlocking elements for maintaining power stored by the second means, release means for activating power stored by the second means, wherein a coupling bar movable along its longitudinal length transfers power stored by the second means to the switch, and the improvement of an independent trip release mechanism enabling the switch-off command and the switch-on command to be independent, wherein the independent trip release mechanism has a releasable coupling having a coupling bar with an oblong opening at its upper end, a roller connected to means for switching on the switch and capable of longitudinal translation in the oblong opening, a two armed lever pivotally connected to the coupling bar below the oblong opening, the two armed lever having an upper arm which can contact the roller, an activating element which is a rod arranged substantially transverse to the coupling bar and connected to the lower arm of the two armed lever so the lever can be pivoted to release contact between the roller and the upper arm, wherein the trip release mechanism acts independent of the interlocking elements.

In preferred embodiments, the activating element has an independent trip release lever provided at the end of the element farthest from the two armed lever, the independent trip release lever having a rest position corresponding to the roller and the upper arm of the two armed lever being in contact, and the trip release lever having means for deflection from the rest position.

Other features and advantages of the invention will be apparent from the following description of the preferred embodiments, and from the claims.

For a full understanding of the present invention, reference should now be made to the following detailed description of preferred embodiments of the invention and to the accompanying drawings.

DESCRIPTION OF THE PREFERRED EMBODIMENTS

A preferred embodiment of the invention will now be described with reference to the drawings.

Figure 1:
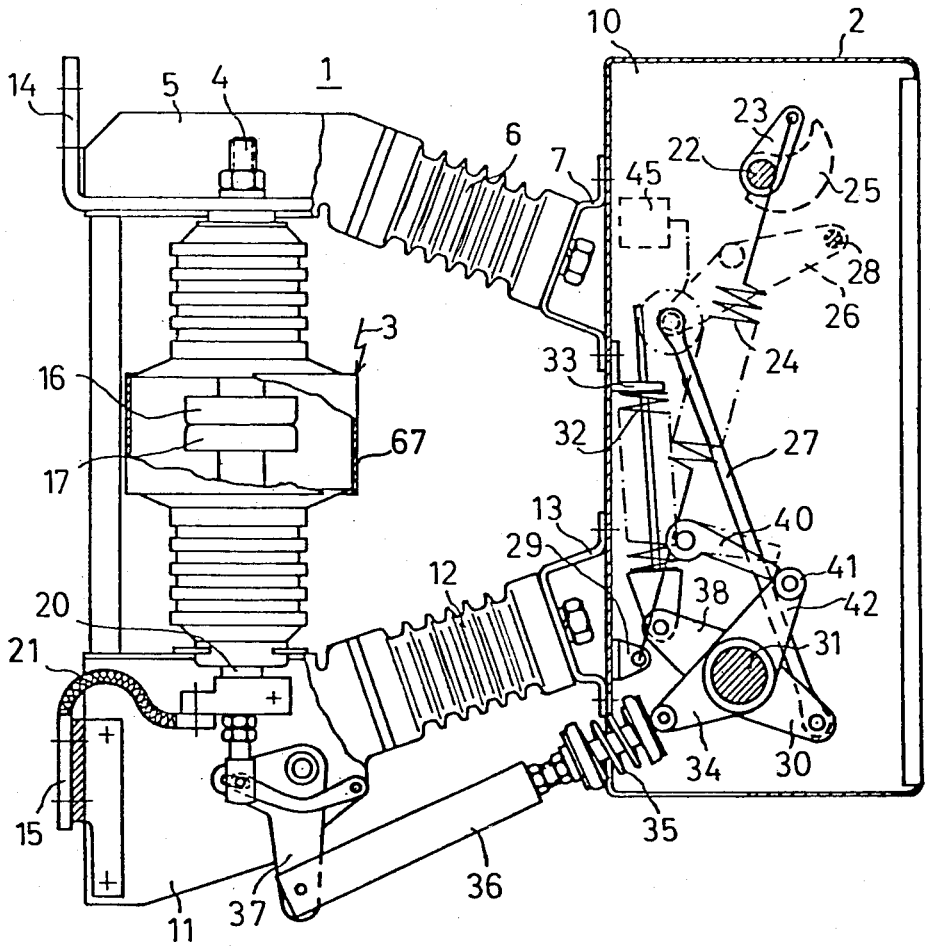
FIG. 1 shows a vacuum output switch for medium operating voltages in a partially cutaway, side view.

Vacuum output switch 1, shown in FIG. 1, contains a driving arrangement 2 and at least one vacuum switching tube 3 at the actual switching position. In a multiple pole configuration of output switch 1, several vacuum switching tubes 3 are arranged adjacent to one another, so that only one vacuum switching tube can be seen in the side view illustrated in FIG. 1.

Vacuum switching tube 3 is attached with its upper stationary connecting pin 4, to upper switching head 5, which is supported by support insulator 6.

Support insulator 6 is attached to carrier rail 7, which is attached to box-shaped housing 10 of the driving arrangement. The vacuum switching tube lies with its lower end in lower switch head 11, which is supported by support insulator 12. Similar to support insulator 6, support insulator 12 is attached to carrier rail 13, which is connected to housing 10 of the driving arrangement. Carrier rails 7 and 13 are designed so that the distance between the portion of the rails connected to housing 10 is less than the distance between switching heads 5 and 11.

In order to connect output switch 1, upper switching head 5 has been provided with upper connecting rail 14, while lower switching head 11 contains lower connecting rail 15. In the switch-on position of output switch 1, the current path extends from upper connecting rail 14 to connecting pin 4, and to connected switching elements 16 and 17, as well as to movable connecting bolt 20 and to flexible current lead 21 which is connected to lower connecting rail 15.

Driving arrangement 2 includes a pivotal cocking lever shaft 22 located in the upper part of housing 10. Lever 23, which is attached to shaft 22, is movable rotationally about shaft 22. Spring 24 is supported in the lower part of housing 10 by stationary flange 29, and it is attached at its upper end to lever 23. In addition, a cam plate 25 arranged on the cocking lever shaft 22, interacts with one end of driving lever 26. The other end of driving lever 26 interacts with coupling bar 27, whose opposite end is flexibly connected to lever 30, which is arranged on control shaft 31. Arm 38 of two armed lever 30 is connected to the free end of compressing spring 32, which is supported by a stationary flange 33 located within housing 10. With this arrangement, tension spring 24 stores the power to turn the switch on, while spring 32 stores the power to turn the switch off.

The transfer of power from control shaft 31 to movable switching element 17 of the vacuum switching tube 3, is performed via two armed lever 34 located on control shaft 31, which operates an angular level 37 connected to movable connecting bolt 20 by means of power contact spring 35 and pull rod 36.

To switch on output switch 1, cocking lever shaft 22 is turned in a counter clockwise direction by a suitable power source, such as a motor, until lever 23 approximates the illustrated dead center position. Spring 24 is then cocked. After releasing a switch interlock (not shown), spring 24 is released by a clockwise turning of cocking lever shaft 22 and a respective pivot of cam plate 25. Driving lever 26 is then pivoted around it stationary bearing 28, while the coupling bar 27 is shifted in a longitudinal direction. Coupling bar 27 operates, by means of lever 30 arranged on control shaft 31, vacuum switching tube 3 and cocks spring 32 by means of lever arm 38. Off-switch jack 40 positions itself against roller 41 of lever arm 42 arranged on control shaft 31, whereby the switch-on position will be maintained in spite of the effect of spring 32.

FIG. 1 shows an overall mechanism 45 for the independent release apparatus (drawn as dotted lines), which prevents an unwanted activation of vacuum switching tube 3. This mechanism is active at the connecting point of driving lever 26 and coupling bar 27 and is shown in more detail in FIGS. 2 and 3.

The drawings illustrate only those parts, which are directly connected with the mechanism for an independent trip release. These parts are driving lever 26, coupling bar 27, control shaft 31 with lever 30 as well as lever arm 42 and off-switch jack 40.

As shown, a two armed coupling lever 46 is arranged at coupling bar 27. One of the lever arms 47 is provided with working surface 51 which interacts with roller 50 of driving lever 26. The other lever arm 52 of coupling lever 46 is influenced by pressure spring 53, which maintains coupling lever 46 in the illustrated normal position. From this position, the power transfer of driving lever 26 ensures via roller 50 to working surface 51 and from there via lever 47 to inserted joint pin 54 of coupling bar 27.

Also an activating element 55 in the form of a rod interacts at lever arm 52. Activation element 55 extends perpendicular to the longitudinal direction of coupling bar 27 and lies approximately in the pivotal plane of coupling lever 46 or a parallel plane thereto. (shown in FIG. 3). The opposite end of the activating element 55 is flexibly connected with independent trip release lever 56, whose other end is pivotally connected to position pin 57. With respect to its positioning on bolt 60, off-switch jack 40 is designed to function as an angular lever, whereby the shorter lever 61 interacts with a similarly positioned release lever 63 on bolt 60. Release lever 63 includes a pin 62. If release lever 63 is activated by the releasing action in the direction of the arrows shown in FIG. 2, off-switch jack 40 is pivoted in a counter clockwise direction, which releases roller 41. At the same time, pin 62 presses against independent trip release lever 56 and swivels it in a clockwise direction together with activating element 55. With it, working surface 51 of lever 47 of coupling lever 46 is moved away from roller 50 of driving lever 26, and the coupling between driving lever 26 and coupling bar 27 is disconnected. Therefore, in the simultaneous presence of both switch-off and switch-on commands, only driving lever 26 would be moved under the influence of the off-switch spring, however, without effecting coupling bar 27. During this process, roller 50 shifts within oblong hole 64 located in the upper part of coupling bar 27.

Release lever 63 can be operated by manual switch-off operations or by an automatic self-activating release mechanism. In addition, the independent release mechanism can be activated in an independent mode from the release lever by pivoting independent trip release lever 56.

Figure 2:
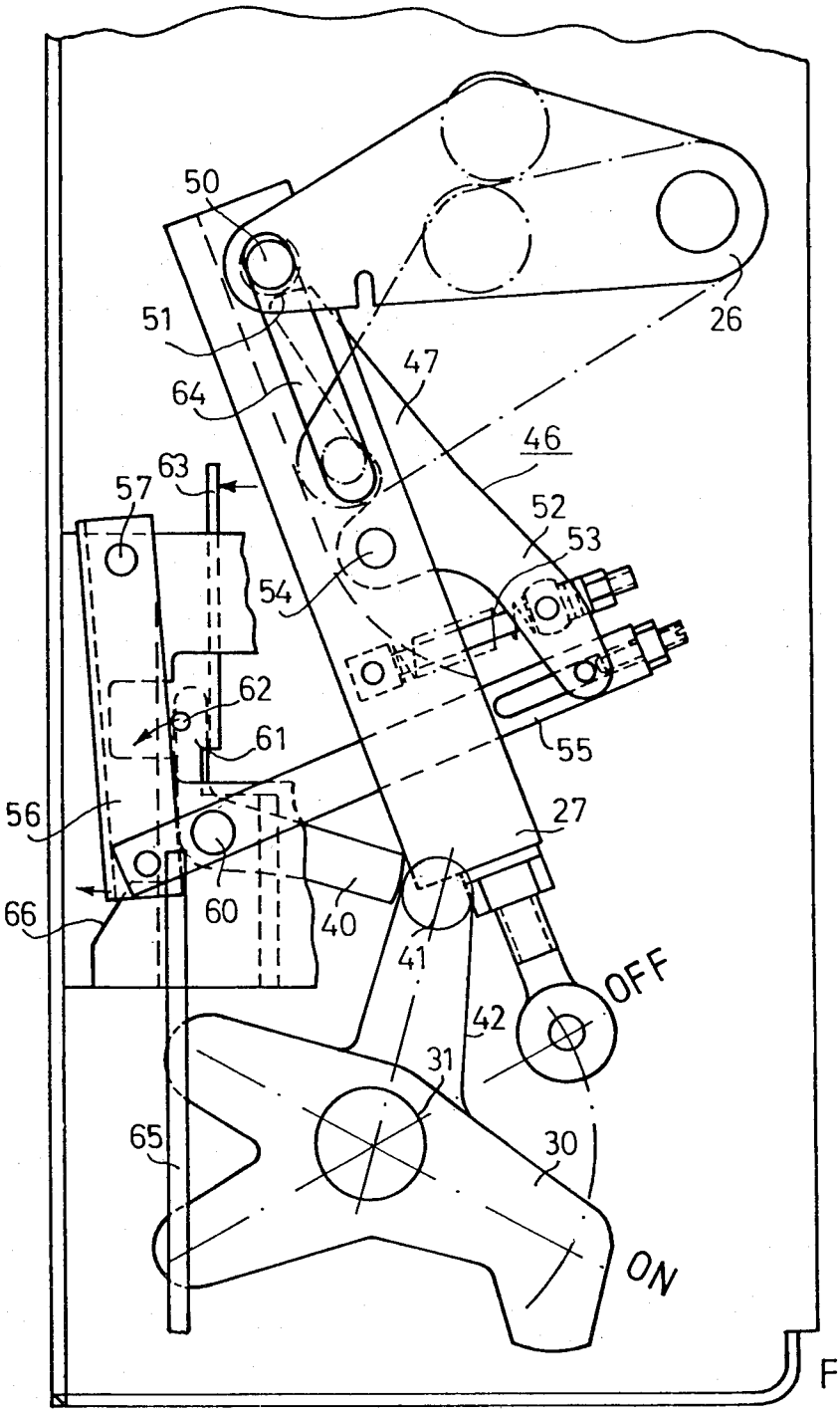
FIG. 2 is a detailed partial, side view of the driving arrangement shown in FIG. 1.
Figure 3:
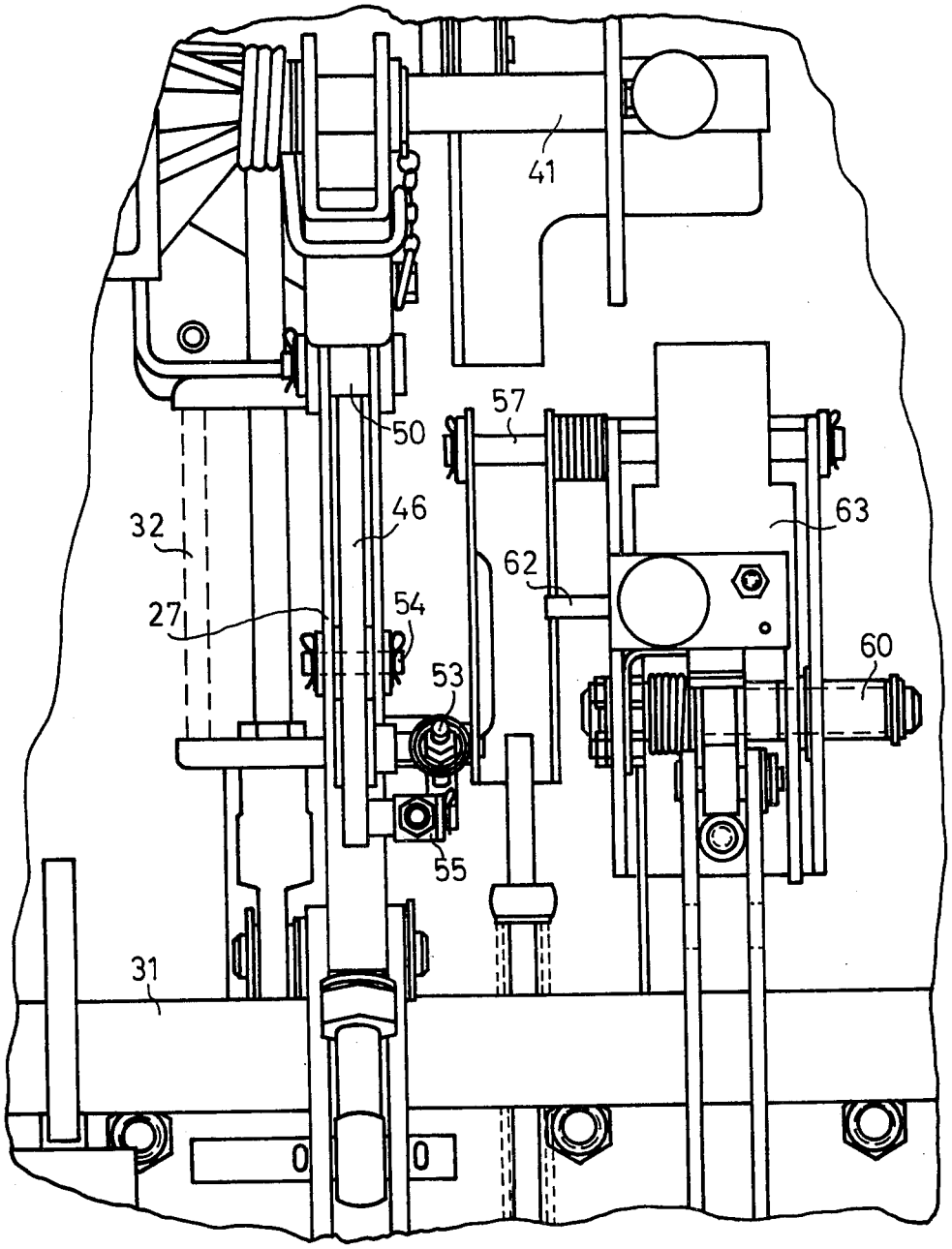
FIG. 3 is a top view of the driving arrangement shown in FIG. 1.

Independent trip release lever 56 can be pivoted by, for example creating a connection to the transport mechanism of a switch system. FIG. 2 provides an example by illustrating a vertical lead bar 65, which upon activation by the transport mechanism displaces independent trip release lever 56 to the left. Therefore, independent trip release lever 56 is forcibly pivoted in a clockwise direction as soon as the switch of the regulating cell 67 is opened. As can be seen, various processes can be utilized to disconnect driving lever 26 from coupling bar 27.

There has thus been shown and described a novel apparatus for a driving arrangement for electrical switches with an independent trip release mechanism which fulfills all the objects and advantages sought therefore. Many changes, modifications, variations and other uses and applications of the subject invention will, however, become apparent to those skilled in the art after considering this specification and the accompanying drawings which disclose preferred embodiments thereof. All such changes, modifications, variations and other uses and applications which so not depart from the spirit and scope of the invention are deemed to be covered by the invention which is limited only by the claims which follow.

What is claimed is:

1. In combination with a driving arrangement for an electrical switch having:

(a) first means for storing power to switch-on said switch;

(b) second means for storing power to switch-off said switch, said first and second means being activated at substantially the same time;

(c) interlocking elements for maintaining power stored by said second means; and (d) release means for activating power stored by said second means, wherein a coupling bar movable along its longitudinal length transfers power stored by said second means to said switch;

the improvement of an independent trip release mechanism enabling the switch-off command and the switch-on command to be independent, which comprises a releasable coupling comprising:

(a) said coupling bar defining an oblong opening at its upper end;

(b) a roller connected to means for switching on said switch, and capable of longitudinal translation along said oblong opening;

(c) a two armed lever pivotally connected to said coupling bar below said portion of said bar defining an oblong opening, said two armed lever having an upper arm which can contact said roller; and (d) an activating element, said element being a rod arranged substantially transverse to said coupling bar, and said element being connected to a lower arm of said two armed lever so said lever can be pivoted to release contact between said roller and said upper arm;

wherein said trip release mechanism acts independent of said interlocking elements.

2. The improvement of claim 1, wherein said activating element has an independent trip release lever provided at the end of said element farthest from said two armed lever, said independent trip release lever having a rest position corresponding to said roller and said upper arm of said two armed lever being in contact, and said trip release having means for deflection from said rest position.

* * * * *